US005935055A

United States Patent [19]

Koch et al.

[11] Patent Number: 5,935,055

[45] Date of Patent: Aug. 10, 1999

[54] INCUBATOR WITH IMPROVED AIR GUIDANCE

[75] Inventors: Jochim Koch, Ratzeburg; Dieter Settgast, Lübeck, both of Germany

[73] Assignee: Drägerwerk AG, Lübeck, Germany

[21] Appl. No.: 08/977,026

[22] Filed: Nov. 24, 1997

[30] Foreign Application Priority Data

Jul. 18, 1997 [DE] Germany ..... 197 30 834

[51] Int. Cl.[6] ..... A61G 11/00

[52] U.S. Cl. ..... 600/22; 600/21

[58] Field of Search ..... 600/21, 22

[56] References Cited

U.S. PATENT DOCUMENTS 4,617,912 10/1986 Beer et al. ..... 600/22

5,707,337 1/1998 Franz ..... 600/22

FOREIGN PATENT DOCUMENTS 0 162 375 A1 11/1985 European Pat. Off. .

40 08 822 A1 9/1991 Germany .

*Primary Examiner*—Lee Cohen

*Assistant Examiner*—Rosiland Kearney

*Attorney, Agent, or Firm*—McGlew and Tuttle, P.C.

[57] ABSTRACT

An incubator for infants with air feed arranged between the lying surface and the housing and with an air return, as well as with a fan and an air heater associated with it. To ensure a uniform temperature in the area of the lying surface and a stable warm air curtain in the area of the longitudinal sides of the incubator, the air feed is designed in the form of free jets using nozzles with diffusors arranged downstream, in the form of slots. Exhaust slots are provided for the air return on both narrow sides of the lying surface.

19 Claims, 1 Drawing Sheet

INCUBATOR WITH IMPROVED AIR GUIDANCE

FIELD OF THE INVENTION

The present invention pertains to an incubator for infants with an air feed arranged between the lying surface and the housing and with an air return, as well as with a fan and an air heater belonging to it.

BACKGROUND OF THE INVENTION

The design embodiment of such an incubator with respect to the air guidance is an important element, on the one hand, for achieving a uniform temperature on the lying surface with the patient, without generating high flow velocities, and, on the other hand, for still ensuring a stable temperature and humidity of the air in the incubator space with the access opening open, especially due to the front flap being open.

To achieve a uniform air guidance, DE 4008822 A1 provides for allowing the air to rise through air feed openings around the lying surface and for drawing it off via an air return channel with an opening in the vicinity of the incubator hood cover. The air is guided essentially in a closed circuit via a fan or ventilator with a downstream air heater and optionally combined with an air humidifier.

Consequently, it has been known from the state of the art that uniform feed of the generally heated and optionally humidified air is advantageous for the most uniform temperature possible on the lying surface.

However, it was found in all attempts at solving this problem so far that great problems are caused for the air guidance especially by the drawing off of the air. Recirculation is preferred for reasons of energy saving and economical reasons, because the heated air would otherwise be released to the environment via openings in the upper area of the incubator hood and would not be essentially recirculated. The drawn-off, heated and relatively humid air is condensed in the air return channel according to the above state of the art. This leads to contaminations and possibly to microbial contamination. In addition to this drawback, the air return channel may obstruct the view of the medical personnel of the operating and patient monitors through the otherwise generally transparent incubator hood, these monitors often standing or being arranged on the front side of the incubator.

According to another prior-art solution in EP 0162375 A1, the warm air is fed in only on the longitudinal sides of the incubator in parallel to the lying surface and is removed or drawn off on the two front sides in relation to the lying surface.

One drawback of this prior-art solution is that direct short circuits of air are formed at the air channels joining each other in the corners of the incubator hood, so that the heated air does not flow uniformly upward, but is drawn off again into the next exhaust channel. One consequence of this deflection of the air is that the temperature profile is highly nonuniform and the warm air curtain desirable in the area of the longitudinal sides of the lying surface does not function. The temperature drop in the interior space of the incubator may reach up to 5° C. when the front flap is opened on one of the longitudinal sides, which is not acceptable in the case of sensitive and sick premature babies.

According to another possible solution, the air is guided in double walls. However, double walls have the drawback that they have a disturbing effect in hospital practice due to a doubling of the surfaces to be cleaned. Another important drawback is that the air above the lying surface is no longer in direct contact with the ambient air of the incubator. Heating processes take much longer, and it also takes longer to cool the incubator with the patient to a lower temperature.

SUMMARY AND OBJECTS OF THE INVENTION

The primary object of the present invention is to ensure a uniform temperature in the area of the lying surface and a stable warm air curtain in the area of the longitudinal sides in the interior space of an incubator with simple means.

According to the invention, an incubator for infants is provided with an air feed arranged between the lying surface and the housing and with an air return, as well as with a fan and an air heater belonging to it. Nozzles with diffusors arranged downstream in the form of slots are provided for feeding in air in the form of free jets on both longitudinal sides of the said lying surface. The exhaust slots are provided on both narrow sides of the lying surface for returning air.

One essential advantage of the present invention is that a very stable warm air curtain with uniform temperature distribution becomes possible in the area of the lying surface even without the use of double walls or air return channels above the lying surface. Even a brief opening of the incubator leads to only a minimal drop in the air temperature in the interior space of the incubator due to the stable warm air curtain.

The slots preferably extend maximally over the entire length of the lying surface. The exhaust slots preferably extend maximally over the entire width of the lying surface. The slots may have a length of about 50–60 cm and the exhaust slots may have a length of 25–45 cm. The nozzle gap is preferably about 5 mm, the opening angle of the diffusors is preferably about 11°, and the discharge gap is preferably about 13 mm.

A double wall may be provided in the hood ceiling of the housing in parallel to the hood, wherein the slots are essentially flush with the limitation of the double wall. The double wall additionally extends in parallel to the hood in the area of the narrower front sides of the incubator and is in air flow connection with the exhaust slots.

Filter material, which preferably consists of a sterile mat based on cellulose, may be introduced into the slots and/or into the exhaust slots. The exhaust slots are preferably in air flow connection with the intake side of the fan and the fan delivers the heated air to the nozzles with diffusors with a higher pressure.

One exemplary embodiment of the present invention will be explained on the basis of the schematic figures, wherein identical parts are designated with the same reference numbers.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 2:
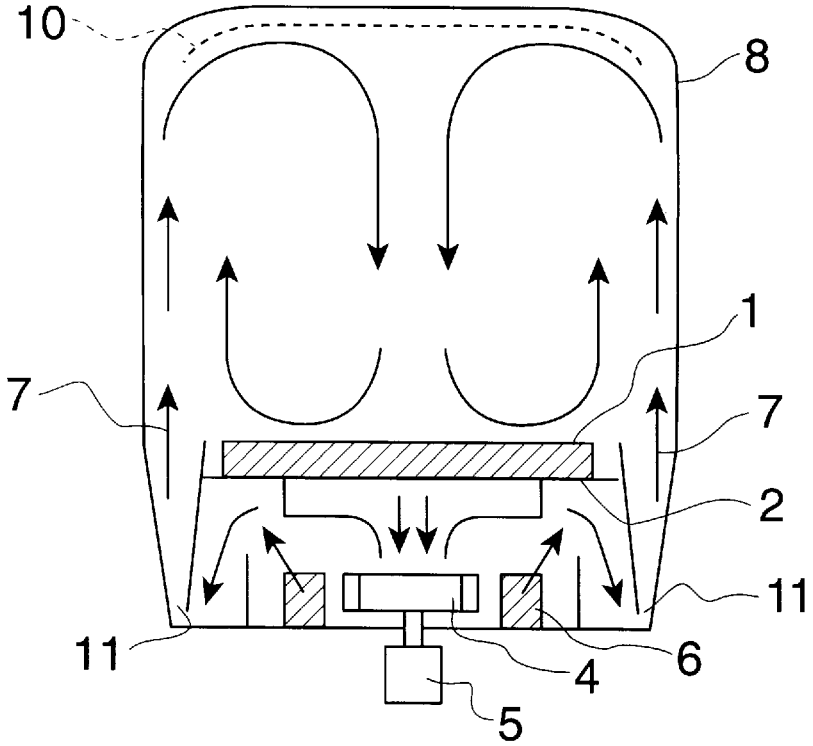
FIG. 2 is a cross sectional view along line II—II, i.e., at right angles to the longitudinal direction of the lying surface according to FIG. 1.

Referring to the drawings in particular, the invention comprises an incubator with a lying surface 1 with a generally rectangular horizontal projection. This lying surface 1 is used to accommodate the sick, possibly premature, small patient, not shown. The lying surface 1 is located, in general, on an intermediate bottom 2, which is likewise shown only schematically and separates the lower part of the incubator. An air feed is provided with a fan 4, which is driven by an electric drive motor 5 belonging to it generally with a maximum power consumption of 10–20 W, is located in this lower part, centrally in the center under the lying surface 1. Heating filaments of the air heater 6 for heating the air are arranged around the fan 4. Both the fan 4 with the drive motor 5 and the air heater 6 and optionally an air humidifier are controlled via a measuring and control unit, not shown, wherein suitable sensors measure the current operating data, e.g., the temperature in the interior space of the incubator, and transmit them to the measuring and control unit. The air in the incubator is essentially recirculated, so that the air being returned enters the suction area with the lower pressure of the fan 4 and the heated air indicated by the arrows in FIG. 2 is delivered from the fan to the nozzles with a higher pressure. The essence of the present invention is as follows:

Nozzle gaps or nozzle openings form a first nozzle 11 and a second nozzle 11. These nozzles are designed as parallel slots, from which the heated air enters the diffusors designed as parallel slots 7. These slots 7 are located on both longitudinal sides of the lying surface 1, directly at the housing 8. The nozzles have the action of a uniform resistance. The pressure generated by the fan 4 in the lower part of the housing 8 is between about 2 and 15 Pa and leads to a uniform discharge over the entire length of the diffusors designed as parallel slots 7 on both longitudinal sides of the lying surface 1 and to the conversion of the pressure energy into velocity energy. The nozzles are designed such that they generate free air jets. Investigations have revealed, on the one hand, that the air discharge velocity should be less than 80 cm per sec, because the air would otherwise entrain cold air due to turbulence, especially with the front flap open 13, and it would lose energy, and, on the other hand, that it should be greater than 40 cm per sec, because it would not otherwise be stable enough for a warm air curtain. The nozzle openings, are designed as diffusors with linearly expanding openings. The air being discharged is thus slowly decelerated and its cross section is expanded, which leads to a more stable free air jet. The opening angle in relation to the central axis in the diffusor-shaped opening area is less than 11° in the exemplary embodiment. In the case of a nozzle gap of 5 mm and a length of 50 cm, a discharge gap with a width of about 13 mm (slots 7) is obtained in the exemplary embodiment. The free air jet brought about by this nozzle/diffusor design is stable over a jet length of about 24 cm, which corresponds to the level of the front flap that can be opened on one of the two longitudinal sides of the housing 8 of the incubator. A warm air curtain is thus generated, which allows the inside temperature to drop only slightly upon opening of the housing 8, especially in the case of the opening of the incubator hood by means of the front flap.

Figure 1:
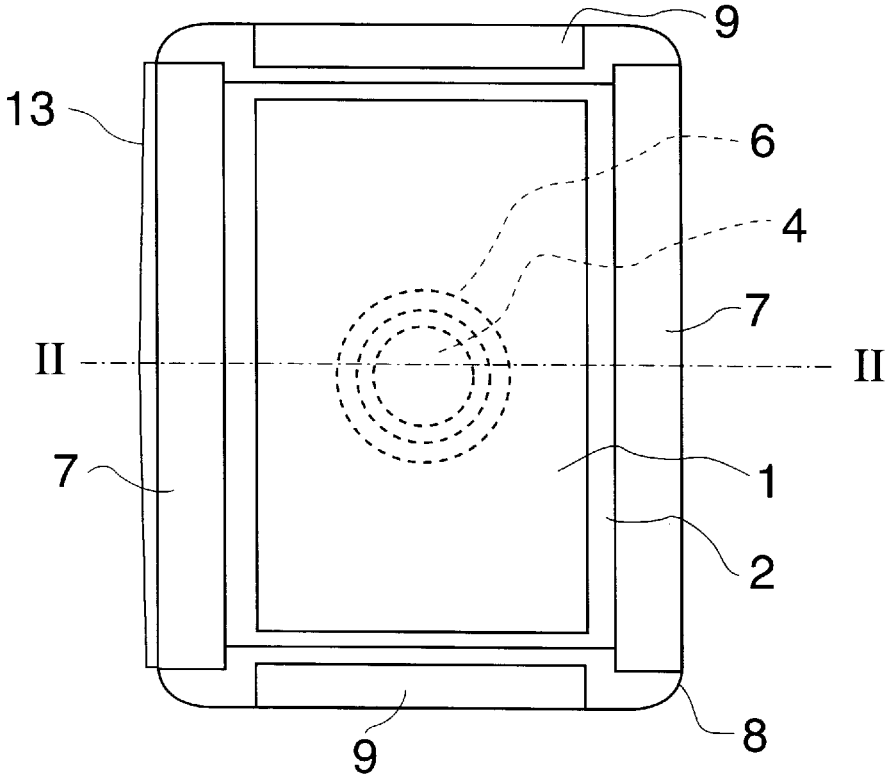
FIG. 1 is a top view of an incubator, according to the invention, at the level of the lying surface.

It is also conceivable, in principle, to design the diffusor cross section as a stepped cross section rather than as a linearly uniform cross section. The walls will extend in parallel in this case, so that a parallel channel with a width of 15 mm joins over a length of 50 cm behind the 5-mm nozzle gap in the example. The nozzle/diffusor combination is arranged on both longitudinal sides of the lying surface 1, so that the circulating air flows symmetrically on both sides. The circulating air flows are indicated by arrows in FIG. 2. Two uniform rollers of air are formed above the lying surface 1, and they lead to a good heat exchange at low air flow velocities in the range of the thermal up-currents, i.e., 8 cm per sec, in the interior space of the incubator above the lying surface 1. Since the action of the free air jet extends beyond the level of the front flap, i.e., markedly beyond 20 cm, no short circuit of air toward the exhaust openings, which are provided on the front sides in the form of exhaust slots 9 (FIG. 1), is formed in this type of air guidance.

An air return is provided wherein the air is drawn from the exhaust slots 9 to the intake side of the fan 4 in the area under the intermediate bottom 2 and essentially in parallel to the longitudinal direction of the lying surface 1. It is, in general, unnecessary to provide the upper part of the housing 8, which is usually designed as a transparent incubator hood, with double walls, but this may be desirable for reducing the radiant loss of the patient or for other reasons.

The essential advantage of the present invention is that no air return channel is needed above the lying surface 1 for returning the air, and the double walls may be abandoned as well. Measurements have revealed that a temperature drop as little as 2° C. occurs with the solution according to the present invention after opening the incubator hood at an interior space temperature of 36° C. in the incubator and an ambient temperature of 20° C. A further reduction in the temperature drop becomes possible if a double wall 10 (indicated by broken line in FIG. 2) is installed in the ceiling area of the incubator hood. Two gaps are thus formed on the longitudinal sides of the incubator directly above the slots 7, the discharge openings of the diffusors. The guidance of the air drawn off would be able to be further improved on the front sides by an at least partial extension of the double wall in the direction of the exhaust slots 9. It was found in connection with the designing of the warm air curtain that the warm air jet must be so long that it passes over the front flap opening in the longitudinal direction of the incubator on both sides, preferably by 20 to 30 mm on both sides. The two slots 7 to the left and right of the lying surface 1 are of equal length for reasons of symmetry. The extension of the warm air curtain over and beyond the front flap opening reduces the amount of cold air drawn into the incubator hood. The diffusors are suitable for being equipped with filter elements, which filter the fresh air and keep it sterile. Mat-like or folded paper filter elements, which also bring about a more uniform flow distribution, are preferably inserted there. Such filters may also be arranged at an upstream location in the intake area of the exhaust slots 9. The action of these filters is to prolong the intervals between two cleanings of the incubator.

The volume flow of the air circulated by the fan 4 is 200 to 250 L per minute during normal operation and may briefly also reach 750 L per minute in an extreme case with the front flap opened.

The length of the slots 7 and of the exhaust slots 9 preferably extends over the entire length of the corresponding incubator sides. The absolute length of the slots 7 is about 50 to 60 cm, and that of the exhaust slots 9 is about 25 to 45 cm.

While specific embodiments of the invention have been shown and described in detail to illustrate the application of the principles of the invention, it will be understood that the invention may be embodied otherwise without departing from such principles.

What is claimed is:

1. An incubator for infants, the incubator comprising:

a housing;

a lying surface with narrow sides and longitudinal sides, said lying surface being provided in said housing, said housing and said lying surface cooperating to provide an incubator interior space;

an air feed arranged adjacent to said lying surface and said housing, said air feed including an air return, a fan and an air heater;

a first nozzle with a diffusor extending downstream from a first nozzle gap to a first diffusor discharge gap and a second nozzle with a diffusor extending downstream from a second nozzle gap to a second diffusor discharge gap, said first nozzle being formed by a slot and said second nozzle being formed by a slot, said slots being provided for feeding air into said incubator interior space in the form of free jets on both said longitudinal sides of said lying surface, said diffusor of said first nozzle having a gradually widening cross-sectional area; and exhaust slots provided on both narrow sides of said lying surface for returning air.

2. The incubator in accordance with claim 1, wherein said slots extend maximally over an entire extent of said longitudinal sides of said lying surface and said exhaust slots extend maximally over an entire extent of said narrow sides of said lying surface.

3. The incubator in accordance with claim 1, wherein said slots have a length of about 50–60 cm and said exhaust slots have a length of about 25–45 cm.

4. The incubator in accordance with claim 1, wherein said nozzles have a nozzle gap of about 5 mm, and said diffusors have an opening angle of about 11° and a discharge gap of about 13 mm.

5. The incubator in accordance with claim 1, further comprising a double wall provided in a hood ceiling of said housing in parallel to the hood, wherein said slot are essentially flush with a limitation of said double wall.

6. The incubator in accordance with claim 5, wherein said double wall additionally extends in parallel to the hood in the area of narrower front sides of the housing and is in air flow connection with said exhaust slots.

7. The incubator in accordance with claim 1, wherein said exhaust slots are in air flow connection with an intake side of said fan and said fan delivers heated air to said nozzles with said diffusors with a higher pressure.

8. The incubator in accordance with claim 1, wherein: said fan provides an air discharge velocity at said nozzles is about 80 cm per second.

9. An incubator for infants, the incubator comprising:

a housing;

a lying surface with narrow sides and longitudinal sides, said lying surface being provided in said housing, said housing and said lying surface cooperating to provide an incubator interior space;

a first nozzle with a first diffusor extending downstream from a first nozzle gap to a first diffusor discharge gap, said first nozzle being formed by an uninterrupted slot extending along one of said longitudinal sides of said lying surface, said first diffusor having a gradually widening cross-sectional area;

a second nozzle with a second diffusor extending downstream from a second nozzle gap to a second diffusor discharge gap said second nozzle being formed by an uninterrupted slot extending along another of said longitudinal sides of said lying surface;

an air feed arranged under said lying surface, said air feed including a fan and an air heater; and uninterrupted exhaust slots provided on both narrow sides of said lying surface for returning air.

10. The incubator in accordance with claim 9, wherein said housing includes a front flap opening and wherein said slots at least extend over an entire length of said front flap and said exhaust slots at least extend over an entire extent of said narrow sides of said lying surface.

11. The incubator in accordance with claim 9, wherein said slots have a length of about 50–60 cm and said exhaust slots have a length of about 25–45 cm.

12. The incubator in accordance with claim 9, wherein said nozzles have a nozzle gap of about 5 mm, and said diffusors have an opening angle of about 11° and a discharge gap of about 13 mm.

13. The incubator in accordance with claim 9, further comprising a double wall provided in a hood ceiling of said housing in parallel to the hood, wherein said slot are essentially flush with a limitation of said double wall.

14. The incubator in accordance with claim 13, wherein said double wall additionally extends in parallel to the hood in the area of narrower front sides of the housing and is in air flow connection with said exhaust slots.

15. The incubator in accordance with claim 9, wherein said exhaust slots are in air flow connection with an intake side of said fan and said fan delivers heated air to said nozzles with said diffusors with a higher pressure.

16. The incubator in accordance with claim 9, wherein: said fan provides an air discharge velocity at said nozzles is about 80 cm per second.

17. An incubator for infants, the incubator comprising:

a housing;

a lying surface with a narrow dimension and longer dimension corresponding generally to dimensions of a lying infant, said lying surface being provided in said housing, said housing and said lying surface cooperating to provide an incubator interior space;

a first nozzle with a first diffusor extending downstream from a first nozzle gap to a first diffusor discharge gap, said first nozzle being formed by an uninterrupted slot extending adjacent to a perimetrical edge of said lying surface running in a direction of said longer dimension of said lying surface, said first diffusor having a gradually widening cross-sectional area;

a second nozzle with a second diffusor extending downstream from a second nozzle gap to a second diffusor discharge gap said second nozzle being formed by an uninterrupted slot extending adjacent to another perimetrical edge of said lying surface;

an air feed arranged under said lying surface, said air feed including a fan and an air heater; and uninterrupted exhaust slots provided extending adjacent to other perimetrical edges running in a direction of said narrower dimension of said lying surface for returning air.

18. The incubator in accordance with claim 17, wherein said slots at least extend over an entire extent of said perimetrical edge, said another perimetrical edge and said other perimetrical edges.

19. The incubator in accordance with claim 17, wherein said housing includes a front flap opening and wherein said slots at least extend over an entire length of said front flap and said exhaust slots respectively extend over an entire extent of said other perimetrical edges.

* * * * *